US005259443A

United States Patent [19]

Osada et al.

[11] Patent Number: 5,259,443

[45] Date of Patent: Nov. 9, 1993

[54] DIRECT PRODUCTION PROCESS OF A LENGTH OF CONTINUOUS THIN TWO-PHASE STAINLESS STEEL STRIP HAVING EXCELLENT SUPERPLASTICITY AND SURFACE PROPERTIES

[75] Inventors: Kuniaki Osada; Takeya Tohge; Masato Noda, all of Yokohama, Japan

[73] Assignee: Nippon Yakin Kogyo Co., Ltd., Tokyo, Japan

[21] Appl. No.: 840,145

[22] Filed: Feb. 24, 1992

Related U.S. Application Data

[63] Continuation-in-part of Ser. No. 682,899, Apr. 9, 1991, abandoned, which is a continuation of Ser. No. 397,322, Aug. 24, 1989, abandoned, which is a continuation of Ser. No. 228,870, Aug. 5, 1988, abandoned, which is a continuation of Ser. No. 42,854, Apr. 27, 1987, abandoned.

[51] Int. Cl.[5] ..... B22D 11/00; B22D 11/06; B22D 11/10

[52] U.S. Cl. ..... 164/475; 164/480; 164/428; 164/437

[58] Field of Search ..... 164/480, 428, 429, 479, 164/463, 423, 437, 475

[56] References Cited

U.S. PATENT DOCUMENTS 4,790,368 12/1988 Kusakawa et al. ..... 164/480

FOREIGN PATENT DOCUMENTS 62-77151 4/1987 Japan ..... 164/428
62-270254 11/1987 Japan ..... 164/428
1-284461 11/1989 Japan ..... 164/428

*Primary Examiner*—Kuang Y. Lin
*Attorney, Agent, or Firm*—Sherman and Shalloway

[57] ABSTRACT

This invention relates to a direct production process of a length of continuous thin two-phase stainless steel strip having excellent superplasticity and surface properties by casting molten two-phase stainless steel directly on either a single roller or a pair of rollers, so that the molten metal is quenched, and a small amount of austenite appears in ferrite matrix.

7 Claims, 8 Drawing Sheets

FIG. 11A
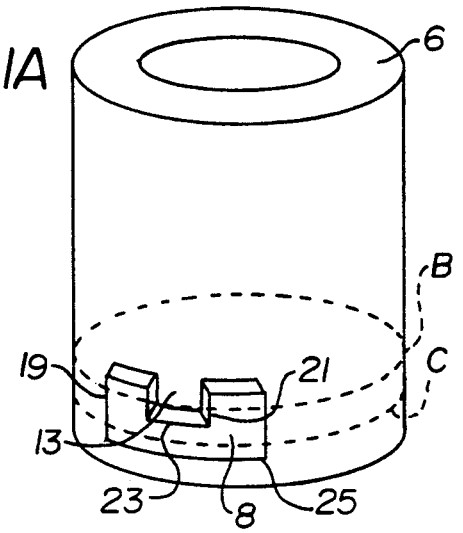
FIG. 11B
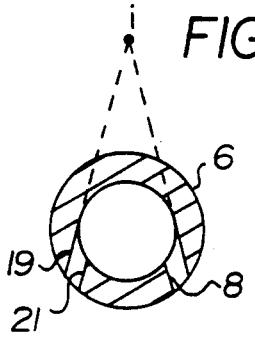
FIG. 11C
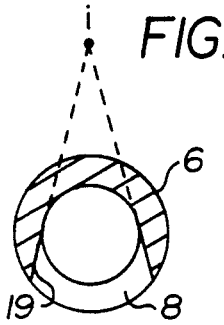
FIG. 12A
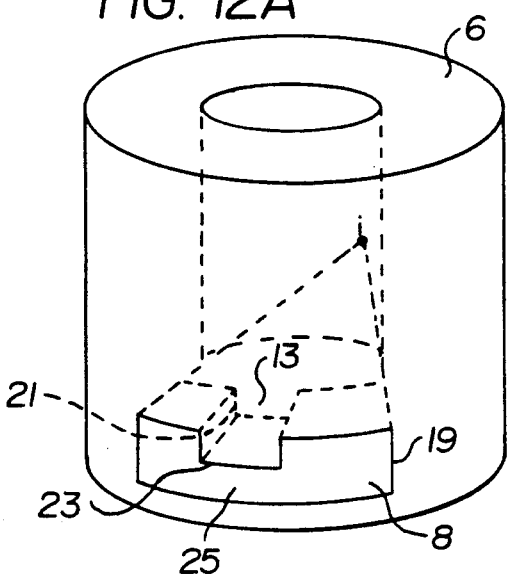
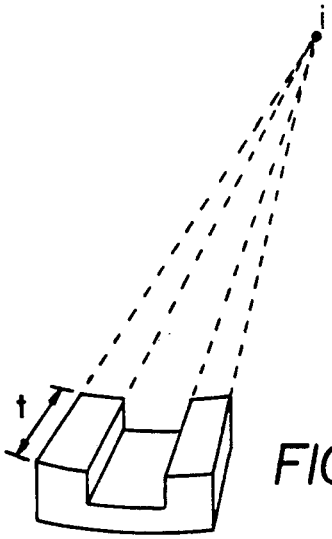
FIG. 12B

DIRECT PRODUCTION PROCESS OF A LENGTH OF CONTINUOUS THIN TWO-PHASE STAINLESS STEEL STRIP HAVING EXCELLENT SUPERPLASTICITY AND SURFACE PROPERTIES

This application is a continuation-in-part of application Ser. No. 07/682,899, filed Apr. 9, 1991, which is a continuation application of Ser. No. 07/397,322, filed Aug. 24, 1989; which is a continuation application of Ser. No. 07/228,870, filed Aug. 5, 1988; which is a continuation application of Ser. No. 07/042,854, filed Apr. 27, 1988, and now all abandoned.

BACKGROUND OF THE INVENTION

1. Field of the invention

This invention relates to a process for the production of a length of continuous thin two-phase stainless steel strip having excellent superplasticity and surface properties from molten two-phase stainless steel by casting.

2. Description of Prior Art

It is already known from, for example, Trans. Quart. A.S.M. 61 (1968), 85 that some kinds of two-phase stainless steel have superplasticity. With a new process employing superplasticity, objects having a complicated shape can be manufactured with less machining time than with a conventional process because of low stress, and high flexibility in machining, resulting from the superplasticity. It is recognized that in order for two-phase stainless steel to exhibit superplasticity, it is necessary that it have a fine-grained texture.

In addition, it is reported in Nikki New Material No. 5, 1986, p. 30, that two-phase stainless steel develops a fine-grained texture having superplasticity when it is quenched and solidified into about 1 mm thick plate consisting of a ferrite phase only, cold-rolled to 80% of its thickness, and then annealed at 1050° C.

As stated above, conventional production processes have to convert a molten two-phase stainless steel into plate, and then subject the plate to a heat treatment, so that a pure ferrite phase or a small amount of austenite remains in a ferrite matrix. This procedure has disadvantages because the heat treatment has to be conducted at elevated temperatures, a combination of repeated process is needed, and the production yield is low.

It is an object of the present invention to provide a direct production process of a length of continuous thin two-phase stainless steel strip having excellent superplasticity, and surface properties as cast.

SUMMARY OF THE INVENTION

A process is provided for the direct casting of a molten two-phase stainless steel alloy to produce a length of continuous thin two-phase stainless strip with a strain rate sensitivity factor (m) of at least 0.3 and having excellent deformability and surface properties. The process comprises flowing molten two-phase stainless steel alloy from a nozzle at a steady flow down an inclined plate having one edge contacting molten metal in a pool of molten metal maintained between a pair of spaced cooling rolls, said inclined plate extending between the nozzle and pool of molten metal and having a cover spaced from and extending over the inclined plate to block inflow of atmospheric gas, molten metal first passing through a hollow cylindrically shaped nozzle having a U-shaped nozzle opening formed in its side at a lower end thereof, said U-shaped nozzle opening having outer vertical walls and spaced inner vertical walls and upper horizontal walls and spaced lower horizontal walls, said nozzle opening having its said outer vertical walls extending substantially along lines tangent to inner walls of the hollow cylindrically shaped nozzle and passing a reference point (i) determined according to width of said cooling rolls, vertical inner walls of the nozzle opening lying substantially along lines extending to said reference point (i), and inside edges formed at boundaries between inside vertical walls and upper horizontal walls of the nozzle opening being chamfered, discharging said molten two-phase stainless steel into said pool of molten metal, and then cooling, solidifying and discharging cast metal from between said spaced cooling rolls, wherein said molten two-phase stainless steel alloy comprises not more than 0.02% of carbon, not more than 2.0% of silicon, not more than 3.0% of manganese, 3–10% of nickel, 20–35% of chromium, 0.5–6.0% of molybdenum, 0.08–0.3% of nitrogen, 0.03–2.0% of at least one of tungsten and vanadium, 0.0005–0.01% of boron, not more than 0.005% of sulfur, and the remainder composed substantially of iron.

The inventors of the present invention made an extensive analysis to eliminate the above-described disadvantages, and have concentrated their efforts on a production process of a thin two-phase stainless steel strip having a thickness of 5 mm or less, having excellent superplasticity and surface properties from molten two-phase stainless steel by either direct casting, continuously quenching, and solidifying it on rollers. Applicants' cast molten SUS 329 $J_1$ by continuous quenching and solidifying on a single roller, and a pair of rollers separately to manufacture a thin stainless steel strip having a thickness of about 55 mm or less, and made experiments on superplasticity in order to determine the strain rate sensitivity factor (m), but they failed to make the factor below 0.3. Accordingly, they used a two-phase stainless steel comprising not more than 0.02% of carbon, not more than 2.0% of silicon, not more than 3.0% of manganese, 3–10% of nickel, 20–35% of chromium, 0.5–6.0% of molybdenum, 0.08–0.3% of nitrogen, 0.03–2.0% of at least one of tungsten or vanadium, 0.0005–0.01% of boron, and not more than 0.005% of sulfur and the remainder being composed substantially of iron, whose processability is referred to in Japanese Patent Publication No. 59-14099, and another two-phase stainless steel containing not more than 2.0% of copper in addition to the above composition for the experiment on the superplasticity, in which to determine the strain rate sensitivity factor (m) at elevated temperatures in the same manner as in SUS 329 $J_1$. As a result, they found that the factor reached 0.3 or more, which perfected the invention.

The present invention relates to a direct production process of a length of continuous thin two-phase stainless steel strip having excellent superplasticity and surface properties as cast, characterized by casting molten two-phase stainless steel by means of a pair of rollers, and continuously quenching and solidifying the same, so that a small amount of austenite remains in a ferrite matrix.

The above and other objects and features of the present invention will be described hereinafter by way of the accompanying drawings, wherein one of the drawings illustrates an example of the resultant stainless steel strip manufactured according to the present invention.

BRIEF DESCRIPTION OF THE DRAWINGS

FIG. 11A is a perspective view of the lower end of the nozzle, showing the nozzling opening therein;

FIG. 11B is an end view taken along dotted line B of FIG. 11A illustrating the open area forming the nozzle and further illustrating that the outer sides of the nozzle lies along a line drawn from point i and tangent to the inside surface of the nozzle;

FIG. 11C is an end view taken along dotted line C of FIG. 11A, illustrating the shape of the nozzle opening of or near the lower portion thereof;

FIG. 12A is a perspective view illustrating the manner in which the nozzle opening is formed in the cylindrical nozzle according to the present invention;

FIG. 12B is a perspective view of the cutout section from the cylindrical nozzle of FIG. 12A;

DETAILED DESCRIPTION OF THE PREFERRED EMBODIMENT

The invention will be explained in more detail in reference to the accompanying drawings.

A two-phase stainless steel comprising not more than 0.02% of carbon, 3–10% of nickel, 20–35% of chromium, 0.5–6% of molybdenum, 0.08–0.3% of nitrogen, 0.0005–0.01% of boron, 0.03–2.0% of either tungsten or vanadium or both, not more than 0.005% of sulfur, which is referred to in Japanese Patent Publication No. 59-14099, can give a micro-grained ferrite texture containing less austenite than SUS 329 $J_1$, when the molten two-phase stainless steel is continuously quenched and solidified on a single roller or a pair of rollers, so that a plate of thickness of about 5 mm or less is manufactured. Moreover, the grains easily slide on their boundaries, which surely contributes to its excellent superplasticity. Therefore, in the present invention, a thin strip of thickness of about 5 mm or less is manufactured from a two-phase stainless steel composition by directly, continuously quenching and solidifying the molten stainless steel on a pair of rollers.

Figure 1:
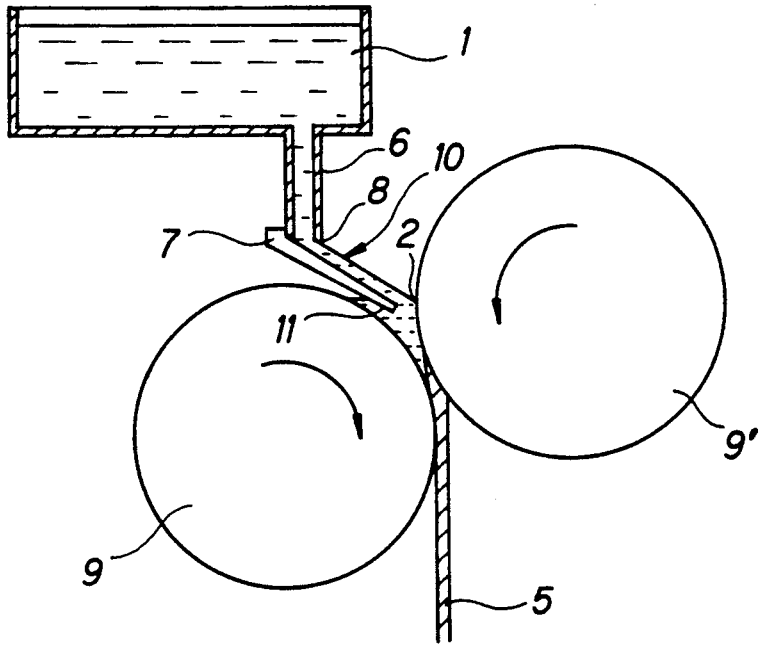
FIG. 1 is a vertical cross-sectional view of an apparatus of one embodiment of the present invention, which uses a pair of rollers 9, 9', and an inclined plate with a cover, to manufacture a length of quenched thin stainless steel strip 5.

FIG. 1 is a vertical cross-section view of an apparatus for the embodiment of the present invention, wherein a pair of water-cooled rollers 9, 9' are used to manufacture a quenched thin stainless steel strip 5. Specifically, the apparatus is constructed substantially of a tundish 1, whose bottom is provided with a downwardly extending generally cylindrical shaped nozzle 6, an inclined refractor plate 7, with an atmospheric gas blocking lid 10 whose upper surface is in contact with the lower end of the nozzle 6, a pair of rollers 9, 9', disposed under the lower end 11 of the inclined plate 7, and a pair of plates, (not shown), each slidably disposed on each side of a pair of rollers 9, 9', for damming up the molten metal poured between a pair of rollers 9, 9', so that the molten metal 2 can be cast downward from an interstice formed where a pair of rollers 9, 9' are closest to each other i.e., the nip between the rollers 9, 9'.

A notch 8 or nozzle opening is provided on one side of the lower end of the generally cylindrical nozzle 6 facing the lower end of the inclined plate 7. See FIGS. 3, 5, 11A–C and 12A. Thus, a portion of the inclined plate 7 between the position of the molten metal nozzle 6 and molten metal pool 2 is covered with an atmospheric gas blocking lid 10, disposed above the inclined plate 7 by means of a spacer illustrated in FIG. 3. The portion of the inclined plate 7 contacting the lower end of the molten metal nozzle 6 and the portion of the metal flowing from the nozzle and onto the inclined plate 7 to the molten metal pool 2 are shielded from oxidizing atmospheric gases to prevent inclusion of gas into molten steel, thereby preventing occurrences of pin-holes in the steel plate.

Figure 2:
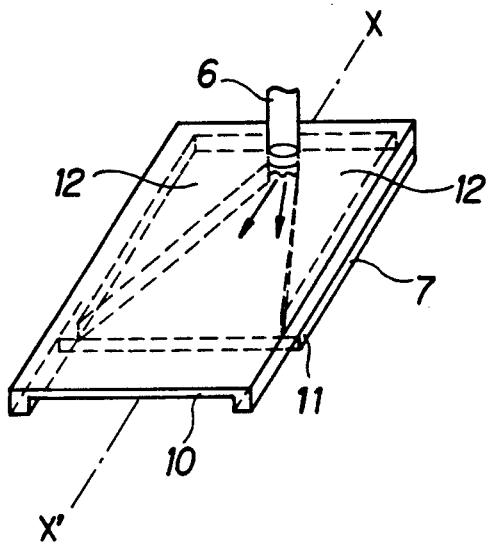
FIG. 2 is a perspective view of a pouring apparatus of one embodiment of the present invention.

The distance between where the lower end of the nozzle 6 is brought into contact with the inclined plate 7, and the lower end of the inclined plate 7 in contact with the pool of molten metal 2 is sufficient so that the molten metal flowing out of the nozzle opening 8 of nozzle 6, spreads out like an unfolded fan, FIG. 2, and can form a steady laminar flow with uniform flow distribution extending over the inclined plate 7 before it reaches the lower end 11 of the inclined plate 7.

Figure 3:
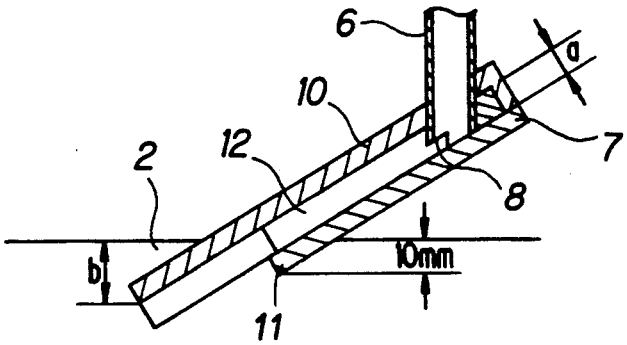
FIG. 3 is a vertical cross-sectional view taken along X-X' in FIG. 2, particularly illustrating the pouring apparatus.
Figure 9:
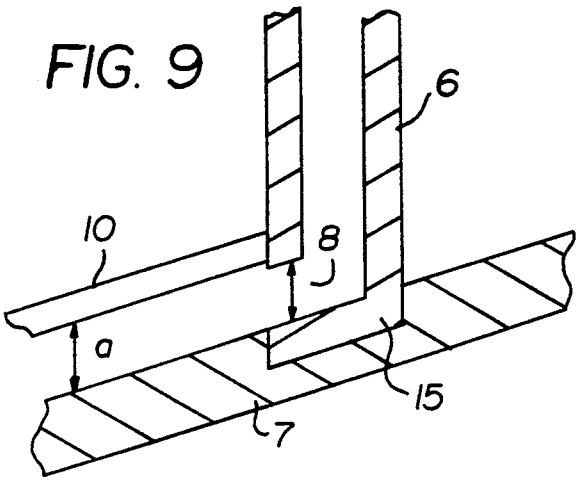
FIG. 9 is a cross-sectional view of the nozzle, inclined plate and blocking lid at the intersection thereof.

The lower end 15 of nozzle 6 is accommodated in a groove 17 formed in the upper surface of inclined plate 7, and the thickness of the bottom portion 15 of nozzle 6 is the same as the depth of the groove 17 so that, in a preferred embodiment, the inside surface of the bottom portion 15 of nozzle 6 is substantially flush with the upper surface of inclined plate 7, as shown in FIGS. 3 and 9. FIG. 9 illustrates that the maximum height of the nozzle opening 8 can be slightly less than the distance (a) between the surface of the upper inclined plate 7 and the lower surface of atmospheric gas blocking lid 10.

The bottom 15 of nozzle 6 is not horizontal or perpendicular to the longitudinal axis of nozzle 6. Instead, the bottom portion 15 of nozzle 6 is angled with respect to the longitudinal axis of the nozzle to correspond to the angle of inclination of the inclined plate 7 as shown in FIGS. 9, 10, 13 and 14.

Figure 14:
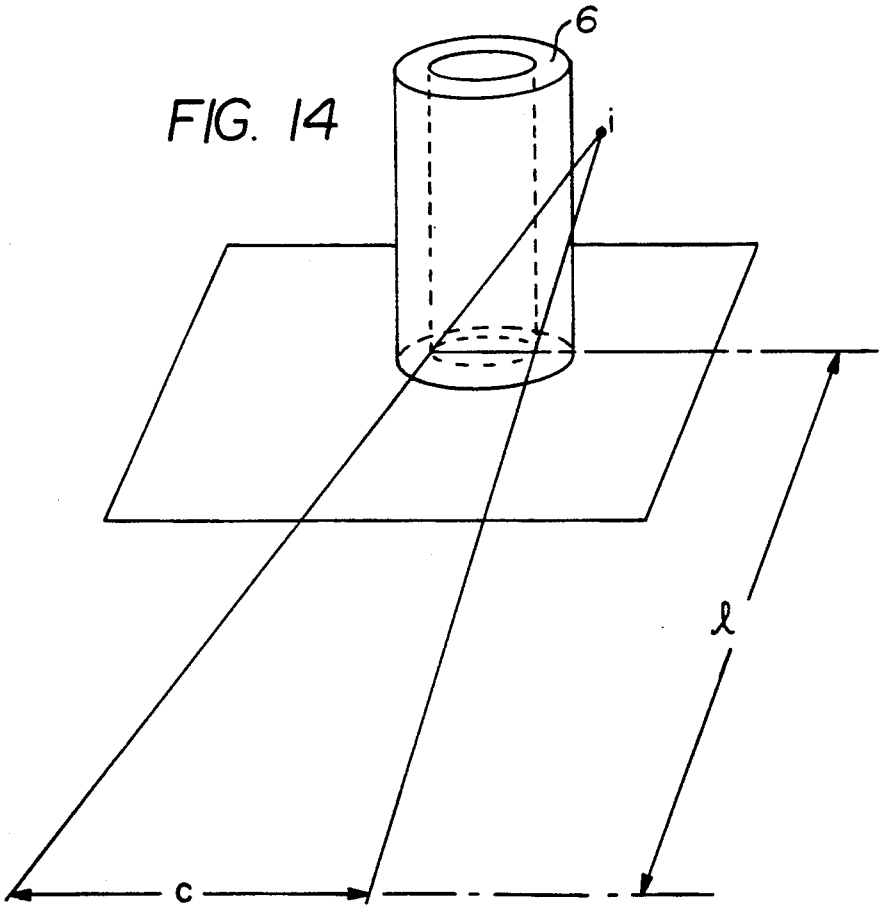
FIG. 14 is a perspective view of a lower portion of the nozzle without a nozzle opening therein, illustrating the position of the reference point i used in determining the shape of the nozzle opening.

The shape of the notch or nozzle opening 8 cut from the nozzle 6 is determined by a reference point (i) shown in FIGS. 5, 11B, 12A, 12B and 14. This reference point (i) is determined by drawing a line from the ends of the rollers tangent to the inside surface of the nozzle 6 and the distance 1 between the rollers and the rollers and nozzle. This is illustrated in FIG. 14 where the distance (c) corresponds to the width of the rollers 9, 9' in the apparatus shown in FIG. 1. Where these lines intersect is point (i) as illustrated in FIGS. 5, 11B, 12A, 12B, and 14. The lower end 11 of the inclined plate 7 and its cover extend to and dip into the molten metal 2 so that the molten metal from the nozzle 6 does not cause any hydromechanical turbulence on the surface or inside the molten metal 2 stored for a time on and between cooling rollers 9, 9'.

In a preferred embodiment, the angle of inclination of inclined plate 7 to the pool of molten metal 2 ranges from about 10 to 40 degrees. In the preferred embodiment illustrate in FIG. 3, the lower edge 11 of the inclined plate 7 is maintained 10 mm below the surface of the molten metal pool 2. The depth (b) of immersion of the blocking lid 10 below the surface of the molten metal pool 2 is preferably from about 10 to 20 mm. However, the immersion depth is not specifically limited so long as the blocking lid 10 does not come into contact with the roll 9 or 9', but the depth of immersion is preferably from about 10 to 20 mm. It is preferred that the depth of immersion of the inclined plate 7 below the surface of molten metal 2 is maintained 10 mm below the surface of the pool of molten metal 2, as shown in FIG. 3. This depth has been determined to prevent gas inclusion into the molten metal.

The distance (a) between the upper surface of inclined plate 7 and the lower surface of blocking lid 10 is equal to or greater than the maximum height of the nozzle opening 8 so as to obtain a laminar flow (see FIGS. 1 and 9). In a preferred embodiment, as shown in FIG. 3, the distance (a) between the inclined plate 7 and blocking lid 10 is greater than the maximum height of the notch or nozzle opening 8 of nozzle 6.

Figure 4:
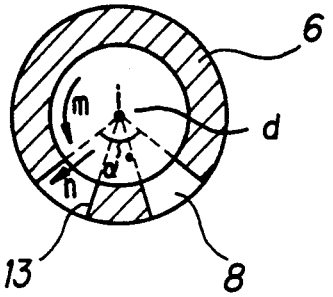
FIG. 4 PRIOR ART
FIG. 4 is a cross-sectional view of the nozzle outlets for molten metal used in the apparatus of the prior art.
Figure 5:
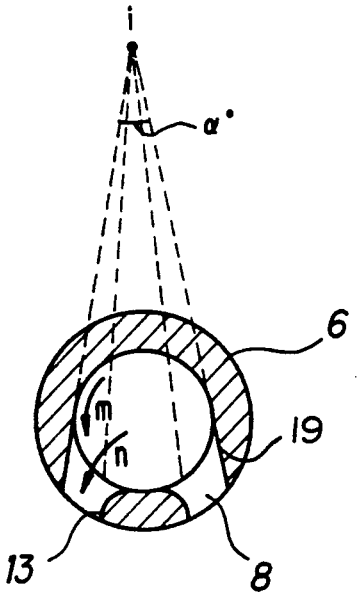
FIG. 5 is a cross-sectional view of the nozzle outlet for molten metal used in the apparatus of the present invention.

In FIG. 4 which shows the prior art devices, the arrow "m" illustrates the molten steel flow in the circumferential direction, the arrow "n" shows the molten steel flow in the radial direction, and "d" is a reference cross-point used to determine the cutting direction of both sides of the nozzle opening according to the roll width.

The preferred gases which can be used in the space between the inclined plate 7 and blocking lid 10 are Ar, $N_2$, He, or $Ar+H_2$. The spacer between blocking lid 10 and inclined plate 7 is preferably 10 to 20 mm in thickness, which is the preferred spacing between the inclined plate 7 and blocking lid 10.

It was unexpectedly discovered that without the use of the blocking lid 10 and an inert atmosphere to shield against oxidation, the resulting cast steel plate would contain blow holes due to the inclusion of an atmospheric gas into the molten steel during the casting process.

However, according to the present invention, when a blocking lid 10 is used with an inert gas in the space between inclined plate 7 and blocking lid 10, the resulting cast steel strip does not contain blow holes. This is because the portion of the inclined plate 7 contacting the lower end 11 of the molten metal nozzle 6, and the metal flowing down the inclined plate 7 to the molten pool 2, are shielded from the atmospheric gas to prevent inclusion of the gas into molten steel, thereby preventing occurrence of pin-holes in the steel plate 5.

In a preferred embodiment, the incline plate 7 can be constructed of zircon ($ZrSiO_2$), alumina ($AL_2O_3$), or graphite. The surface of the inclined plate 7 in contact with the molten metal is flat, but need not be smoothed or polished.

The atmospheric gas blocking lid 10 and blanket of inert gas serves to prevent the molten metal from oxidizing. It is preferred that an inert gas blanket be maintained above the entire pool 2 of molten two-phase stainless steel alloy being retained between rollers 9, 9.

As illustrated in FIGS. 5, 12A, 12B and 14, the outer vertical walls 19 of U-shaped opening 8 of the nozzle 6, are cut-out or lie along lines tangent to the inside walls (in dotted lines) of nozzle 6, said lines passing a reference point (i) determined according to the width of the rollers 9, 9'. The U-shaped nozzle opening 8 also comprises inner vertical walls 21, an upper horizontal wall 23 and lower horizontal wall 25. The inner vertical walls 21 of U-shaped nozzle opening 8 are cut-out along the axial directions from the reference point (i). The inside edges formed at boundaries between the cut-out surfaces 13 (i.e. inner vertical wall 21 and upper horizontal wall 23), and the nozzle 6 inner surface are chamfered (See FIG. 5).

With the above-shaped nozzle 6, resistance due to disturbance and directional change of the molten metal flow can be reduced, and turbulent flow of the molten metal at the outlet 8, and on the inclined plate 7 can be prevented.

Figure 10:
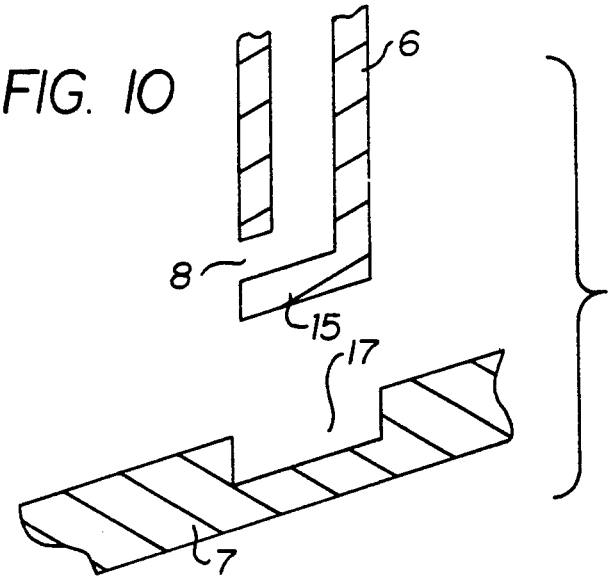
FIG. 10 is exploded cross-sectional view of the nozzle and inclined plate of the present invention illustrating the recess in the surface of the inclined plate which receives the lower end of the nozzle.
Figure 13:
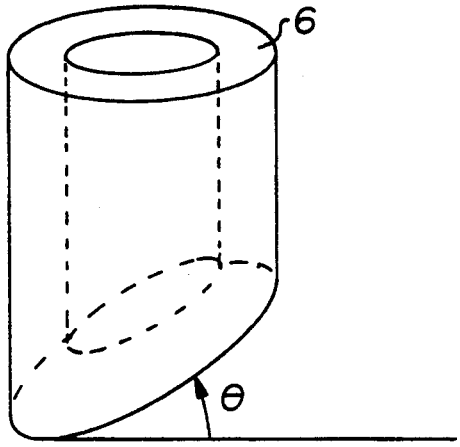
FIG. 13 is a perspective view of a side of the vertical nozzle illustrating the angle $\theta$ the bottom of the nozzle makes with respect to the horizontal.

The nozzle 6 is preferably located at a position where the upper surface of the inclined plate 7 is flush with an upper surface of nozzle bottom 15, and symmetrical with respect to the inclined plate 7 as illustrated in FIGS. 2 and 9. The lower end section of the nozzle 6 and a recess 17 formed in the inclined plate 7 to accommodate a lower end of the nozzle are shown in an exploded view in FIG. 10. FIG. 11 illustrates the nozzle opening 8 and lug or tongue portion 13 of the nozzle as viewed from the front of the nozzle. As shown in FIGS. 9 and 10, the angle of the bottom portion 15 of the nozzle 6 is preferably the same as the angle of the inclined plate.

Figure 8:
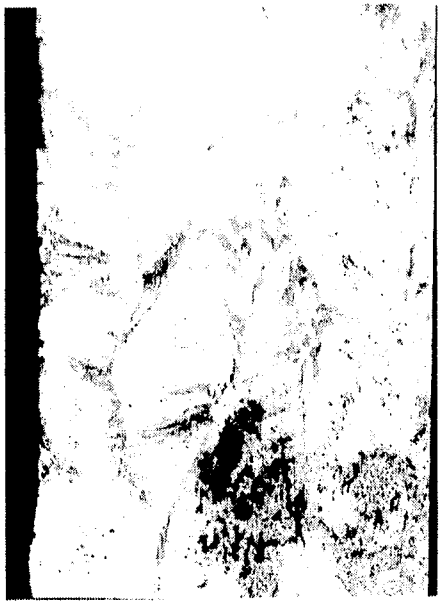
FIG. 8 is a 200-fold magnified optical micrograph showing a fine-grained texture inside a quenched thin stainless steel strip 5 manufactured according to the present invention.

A thin stainless steel strip produced in the above-described embodiment of the present invention, proves to have a fine-grained texture, as shown by a micrograph (×200) in FIG. 8, in which some austenite is in sight on the inside ferrite grains.

According to the present invention, the thickness of the stainless steel strip can be changed by adjusting the diameter, material, and rotation speed of the roller or rollers. Additionally, the gap between the rollers 9,9' and cooling rate thereof can also be changed. In any case, in a thin stainless steel strip of thickness of about 5 mm or less, there can be found a texture with a small amount of austenite deposited on or inside ferrite gains. Two-phase stainless steels, which are related in the following examples, have excellent superplasticity and surface properties as cast.

The micro-structure of two-phase stainless steel at solidification depends largely on the cooling rate. Specifically, the remarkable effects of cooling rate can be observed based on the amount, shape and distribution of austenite precipitated in the ferrite matrix. Furthermore, marked differences are noted in the degree of segregation and solid dissolution of the component elements to the individual phases.

In order to obtain a good superplasticity with this type of steel, it is necessary that course austenite grains do not exist after direct casting, and excess amounts of elements more than at equilibrium dissolve in the ferrite phase so that the micro-structure can rapidly transform into a fine two-phase micro-structure in a subsequent heating.

Furthermore, it has been known that when superplastic materials fracture after large superplastic elongation, numerous voids generate inside the material, which connect and lend to a final fracture. In this case, when a foreign substance, (oxide or the like) is present which is harder than the matrix, it will be a starting point of voids.

Based on these factors, the relationship between the mechanism of the direct casting system and m-value, which is a measure of the degree of superplasticity, takes into consideration immersion of the inclined plate in the molten metal pool and addition of the cover. These features of the present invention are advantageous for three reasons described below in order to obtain a good superplastic material. First, it is easier to obtain laminar flow of the molten metal, which provides a higher thermal conductivity than with turbulent flow. Therefore, the cooling rate is increased, thereby providing an ideal rapidly solidified two-phase stainless steel micro-structure. Second, the danger of oxygen inclusion is remarkably reduced, and the number of foreign substances such as oxides is considerably decreased. This leads to a decrease in the amount of foreign substances which become starting points of voids during superplastic elongation. Third, defects due to gas inclusion are remarkably reduced, thus reducing the number of sites where voids tend to aggregate during superplastic elongation. If gas inclusion defects are present in rapid solidified plate materials prior to elongation, these defects will tend to cause early fracture due to cavitation by connection of voids in association with elongation of superplastic materials.

Further modification of the nozzle shape can have the same effects as the second and third reasons discussed above. Of the three points discussed above, the first factor effects a considerable improvement in the magnitude of m-value, stabilizing the change in m-value in association with elongation. The second and third factors are major factors which disturb superplastic ductility, which relates to rapid deterioration in m-value in association with elongation.

The superplastic properties of a two-phase stainless steel produced by direct casting can be largely varied by modification of the production system. As in conventional systems, when heat treatment is repeated in subsequent processes, the solidified micro-structure is not important, because the micro-structure is conditioned in subsequent processes. However, in this material which is evaluated in the cast condition, it is necessary to consider the fact that solidification related parameters largely affect the properties of the resulting material.

The invention will be understood more readily with reference to the following examples. However, these examples are intended to illustrate the invention and are not to be constructed to limit the scope of the invention.

EXAMPLE

Table 1 shows the composition of various stainless steels used in the examples of this invention (Nos. 3–7) and the Comparative Examples thereof (Nos. 1 and 2). Table 2 shows the casting condition (roller type, roller diameter, amount of circulating cooling water for rollers strip thickness and cooling rate), maximum elongation and strain rate sensitivity factor m at 1000° C. of stainless steels listed in Table 1.

Figure 6:
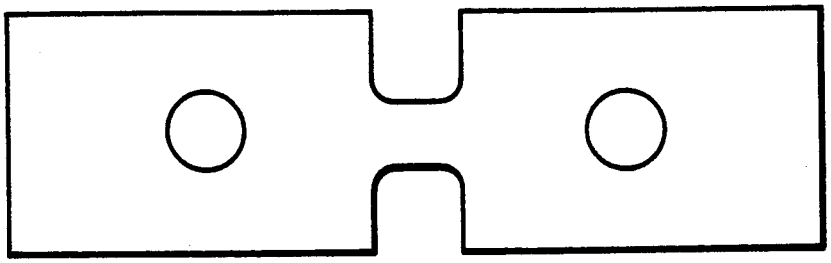
FIG. 6 is a plan view of a test piece of stainless steel used in a tensile test.
Figure 7:
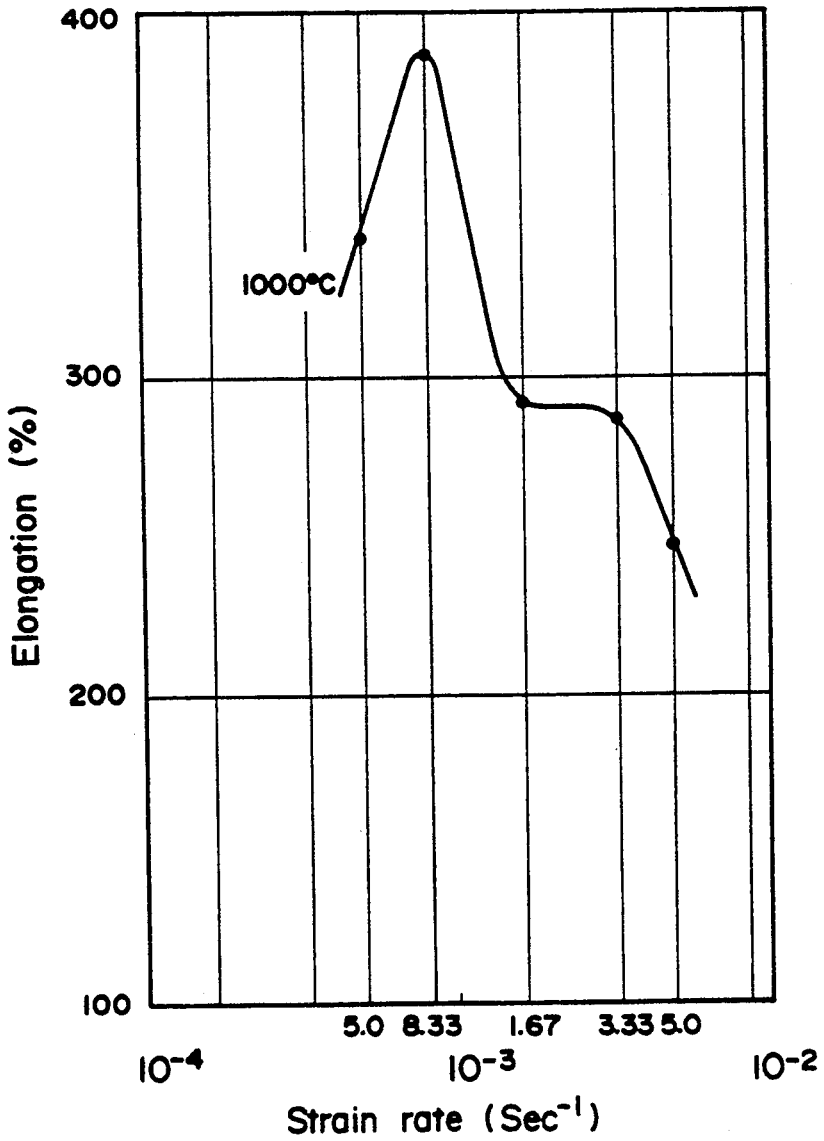
FIG. 7 is a graph showing the relation between strain rate ($sec^{-1}$) and elongation (%) of No. 4 stainless steel specimen manufactured by means of a pair of rollers according to the present invention.

In advance of the experiment for the determination of the maximum elongation, a test piece such as shown in FIG. 6 is prepared so that the drawing direction is in conformity with the direction perpendicular to the casting direction and the jaw interval falls 5.0 mm. Each test piece is drawn at a constant strain rate of $5.0\times10^{-4}$–$5.0\times10^{-3}$ $sec^{-1}$ after having been kept for 5 minutes at elevated temperatures. FIG. 7 shows the relation between strain rate ($sec^{-1}$), and elongation (%) of No. 4 stainless steel specimen at 1000° C. Table 3 shows the relation between strain rate ($sec^{-1}$), and deformation resistance ($kg/mm^2$) of the same specimen at 1000° C.

TABLE 1

| | No. | C | Si | Mn | P | S | Ni | Cr | Mo | Cu | N | B | V | W |
|---|---|---|---|---|---|---|---|---|---|---|---|---|---|---|
| Comparative Examples | 1 | 0.028 | 0.61 | 0.54 | 0.025 | 0.005 | 5.01 | 23.70 | 1.48 | 1.50 | 0.114 | — | — | — |
| | 2 | 0.031 | 0.72 | 0.52 | 0.026 | 0.006 | 4.96 | 24.48 | 1.51 | — | 0.099 | — | — | — |
| Examples of Invention | 3 | 0.009 | 0.60 | 0.29 | 0.023 | 0.0007 | 4.68 | 24.00 | 2.04 | 1.44 | 0.113 | 0.0011 | 0.08 | 0.19 |
| | 4 | 0.008 | 0.60 | 0.34 | 0.020 | 0.001 | 5.55 | 27.38 | 3.06 | 0.28 | 0.110 | 0.0030 | — | 0.19 |
| | 5 | 0.013 | 1.51 | 0.60 | 0.021 | 0.001 | 5.85 | 24.50 | 2.00 | — | 0.080 | 0.0009 | 0.13 | — |
| | 6 | 0.009 | 0.61 | 0.55 | 0.020 | 0.0009 | 6.65 | 26.01 | 3.40 | 0.61 | 0.122 | 0.0010 | 0.08 | 0.15 |
| | 7 | 0.010 | 0.57 | 0.60 | 0.022 | 0.001 | 6.01 | 25.01 | 3.00 | — | 0.101 | 0.0009 | — | 0.14 |

TABLE 2

| | | Casting condition | | | | | | Strain rate |
|---|---|---|---|---|---|---|---|---|
| | No. | Roller type | Roller diameter (mm) | Amount of circulating cooling water (L/mm) | Strip thickness (mm) | Cooling rate (°C./sec) | Max. Elongation (%) | Sensitivity factor (m) at 1000° C. |
| Comparative Examples | 1 | single roller | 600 | 280 | 0.8 | $10^3$–$10^5$ | 80.0 | 0.22 |
| | 2 | a pair of rollers | 400 | 320 | 1.2 | 10–$10^4$ | 63.0 | 0.18 |
| Examples of Invention | 3 | single roller | 600 | 480 | 0.8 | $10^5$–$10^6$ | 311.0 | 0.33 |
| | 4 | a pair of rollers | 400 | 320 | 1.2 | $10^2$–$10^4$ | 404.0 | 0.51 |
| | 5 | a pair of rollers | 400 | 320 | 2.0 | 10–$10^2$ | 210.0 | 0.33 |
| | 6 | single roller | 600 | 480 | 3.8 | $10^2$–$10^4$ | 313.0 | 0.44 |
| | 7 | a pair of rollers | 400 | 480 | 4.9 | $10^3$–$10^5$ | 307.0 | 0.31 |

TABLE 3

| | | | | | |
|---|---|---|---|---|---|
| Strain rate ($sec^{-1}$) | $5.00\times10^{-4}$ | $8.33\times10^{-4}$ | $1.67\times10^{-3}$ | $3.33\times10^{-3}$ | $5.00\times10^{-3}$ |
| Deformation | 0.28 | 0.40 | 0.54 | 0.63 | 0.79 |

TABLE 3-continued

| resistance (kg/mm²) |
|---|

The strain rate sensitivity factor m of the specimen can be determined by putting its measurement results in the following equation, $$\sigma = K\epsilon^{-m}$$

where $\sigma$ stands for deformation resistance (kg/mm²), K is a constant and $\epsilon$ is a strain constant ($sec^{-1}$), where by m is determined as 0.51. Table 2 shows the strain rate sensitivity factor (m) of all other specimens determined in the same way, together with their maximum elongation.

Meanwhile, according to a report entitled "Superplasticity and Superplastic Forming Process", in Mat. Sci. & Tech., 1, 925 (Nov. 1985), it is made clear that the superplasticity of micro-grained texture shows a strain rate sensitivity factor of 0.3 or more. Therefore, it becomes evident from table 2 that five specimens Nos. 3-7, which were all manufactured according to the present invention, have superplasticity.

The superplasticity is accounted for by the fact that crystallites torn by strain in the progress of earlier plastic deformation crystallize again by thermal energy in the progress of the further deformation, and grow up to microcrystallites capable of causing superplasticity.

As stated above, according to the present invention, a continuous thin stainless steel strip of thickness of about 5 mm or less, having excellent superplasticity and surface properties as is cast, can be manufactured easily at lower cost by casting molten two-phase stainless steel on either a single roller or a pair of rollers so that the molten metal is quenched and solidified.

What is claimed is:

1. A process for the direct casting of a molten two-phase stainless steel alloy to produce a length of continuous thin two-phase stainless strip with a strain rate sensitivity factor (m) of at least 0.3 and having excellent superplastic deformability and surface properties, the process comprising:

flowing molten two-phase stainless steel alloy from a nozzle at a steady flow down an inclined plate having one edge contacting molten metal in a pool of molten metal maintained between a pair of spaced cooling rolls, said inclined plate extending between the nozzle and pool of molten metal and having a cover spaced from and extending over the inclined plate to block inflow of atmospheric gas, molten metal first passing through a cylindrical shaped nozzle having a notch opening formed in its side at a lower end thereof, said notch opening cut along lines tangent to the inner walls of the cylindrical shaped nozzle and passing a reference point (i) determined by the width of said cooling rolls and the distance between the rollers and the nozzle, and edges formed at boundaries between the cut-out surface and the nozzle inner surface opening being chamfered, discharging said molten two-phase stainless steel into said pool of molten metal, and then cooling, solidifying and discharging cast metal from between said spaced cooling rolls, wherein said molten two-phase stainless steel alloy comprises not more than 0.02% of carbon, not more than 2.0% of silicon, not more than 3.0% of manganese, 3-10% of nickel, 20-35% of chromium, 0.5-6.0% of molybdenum, 0.08-3.0% of nitrogen, 0.03-2.0% of at least one of tungsten and vanadium, 0.0005-0.01% of boron, not more than 0.005% of sulfur, and the remainder composed substantially of iron.

2. The process of claim 1, wherein said molten two-phase stainless steel alloy comprises not more than 2.0% of copper.

3. A process for the direct casting of a molten two-phase stainless steel alloy to produce a length of continuous thin two-phase stainless strip with a strain rate sensitivity factor (m) of at least 0.3 and having excellent superplastic deformability and surface properties, the process comprising:

flowing molten two-phase stainless steel alloy from a nozzle at a steady laminar flow down an inclined plate having one edge contacting molten metal in a pool of molten metal maintained between a pair of spaced cooling rolls, said inclined plate extending between the nozzle and pool of molten metal having a cover spaced from and extending over the inclined plate to block inflow of atmospheric gas, molten metal first passing through a cylindrical shaped nozzle having a U-shaped nozzle opening formed in its side at a lower end thereof, said U-shaped nozzle opening having outer vertical walls and spaced inner vertical walls and upper horizontal walls and spaced lower horizontal walls, said nozzle opening having its said outer vertical walls extending substantially along lines tangent to inner walls of the cylindrical shaped nozzle and passing a reference point (i) determined by the width of said cooling rolls and the distance between the rollers and the nozzle, vertical inner walls of the nozzle opening lying substantially along lines extending to said reference point (i), and inside edges formed at boundaries between inside vertical walls and upper horizontal walls of the nozzle of which inner surface are chamfered, discharging said molten two-phase stainless steel into said pool of molten metal, and then cooling, solidifying and discharging cast metal from between said spaced cooling rolls, wherein said molten two-phase stainless steel alloy comprises not more than 0.02% of carbon, not more than 2.0% of silicon, not more than 3.0% of manganese, 3-10% of nickel, 20-35% of chromium, 0.5-6.0% of molybdenum, 0.08-0.3% of nitrogen, 0.03- 2.0% of at least one of tungsten and vanadium, 0.0005-0.01% of boron, not more than 0.005% of sulfur, and the remainder composed substantially of iron.

4. The process of claim 3, wherein the inclined plate has a lower edge submerged at least 10 mm in the pool of molten metal maintained between the pair of spaced cooling rollers.

5. The process of claim 3, wherein the cover over the inclined plate has its lower edge submerged below the surface of the pool of molten metal, and an inert gas is maintained between the inclined plate and the cover to prevent the oxidation of metal flowing down the inclined plate.

6. The process of claim 3, wherein a lower horizontal wall of the nozzle opening is flush with an upper surface of the inclined plate.

7. The process of claim 3, wherein the angle of the inclined plate to the surface of the molten metal pool is from about 10°-40°, and the depth of immersion of the cover is from about 10-20 mm, and the cover is spaced from about 10-20 mm from the inclined plate.

* * * * *